US008708197B1

(12) United States Patent
Brewer

(10) Patent No.: US 8,708,197 B1
(45) Date of Patent: Apr. 29, 2014

(54) PORTABLE REFRIGERATOR SYSTEM

(76) Inventor: Kenneth L. Brewer, Jamaica, NY (US)

( * ) Notice: Subject to any disclaimer, the term of this patent is extended or adjusted under 35 U.S.C. 154(b) by 160 days.

(21) Appl. No.: 13/308,838

(22) Filed: Dec. 1, 2011

(51) Int. Cl.
*B67D 7/80* (2010.01)
*B67D 7/74* (2010.01)

(52) U.S. Cl.
USPC ..... 222/146.6; 222/146.1; 222/131; 222/132; 222/144.5; 222/145.1; 222/113; 222/129; 62/389; 62/390; 62/395

(58) Field of Classification Search
USPC ..... 222/146.1, 146.6, 130–132, 145.1, 222/144.5, 136, 182, 113, 129; 62/389, 62/390, 395
See application file for complete search history.

(56) References Cited

U.S. PATENT DOCUMENTS

| | | | | | |
|---|---|---|---|---|---|
| 127,958 | A | * | 6/1872 | Cohen | 62/338 |
| 1,230,914 | A | * | 6/1917 | McMoore | 62/319 |
| 1,513,926 | A | * | 11/1924 | Norwood | 62/390 |
| 2,896,423 | A | * | 7/1959 | Pettinato | 62/249 |
| 3,139,219 | A | * | 6/1964 | Gran | 222/131 |
| 3,266,672 | A | * | 8/1966 | Dean | 222/129.1 |
| 3,280,591 | A | * | 10/1966 | Webster | 62/390 |
| 3,312,083 | A | * | 4/1967 | Scoggins et al. | 62/390 |
| 3,572,054 | A | * | 3/1971 | Curcio | 62/390 |
| 3,669,314 | A | | 6/1972 | Goings | |
| 3,955,713 | A | * | 5/1976 | Hurley | 222/129.4 |
| 4,059,181 | A | * | 11/1977 | Greenfield et al. | 194/242 |
| 4,342,202 | A | | 8/1982 | Knutson | |
| 4,493,441 | A | * | 1/1985 | Sedam et al. | 222/129.1 |
| 4,496,080 | A | * | 1/1985 | Farber et al. | 222/129.3 |
| 4,637,222 | A | | 1/1987 | Fujiwara et al. | |
| 4,679,707 | A | * | 7/1987 | Sedam | 222/129.1 |
| 4,688,701 | A | * | 8/1987 | Sedam | 222/129.1 |
| 4,793,518 | A | * | 12/1988 | Burton | 222/129.3 |
| 4,854,655 | A | * | 8/1989 | Saunders et al. | 312/257.1 |
| 4,901,887 | A | * | 2/1990 | Burton | 222/131 |
| 4,913,318 | A | * | 4/1990 | Forrester | 222/129 |
| 4,921,139 | A | * | 5/1990 | Fischer et al. | 222/129.1 |
| 4,960,228 | A | * | 10/1990 | Takahashi et al. | 222/129.1 |
| 4,982,877 | A | * | 1/1991 | Burton | 222/135 |
| 5,124,088 | A | * | 6/1992 | Stumphauzer | 261/121.1 |
| D333,070 | S | | 2/1993 | Chinn | |
| 5,497,918 | A | * | 3/1996 | Brilanchik | 222/626 |
| 5,564,601 | A | * | 10/1996 | Cleland et al. | 222/129.1 |
| 5,619,901 | A | * | 4/1997 | Reese et al. | 99/275 |
| 5,697,526 | A | * | 12/1997 | Lee | 222/113 |
| 5,701,754 | A | | 12/1997 | Choi et al. | |
| 5,836,481 | A | * | 11/1998 | Strohmeyer et al. | 222/182 |
| 5,960,701 | A | * | 10/1999 | Reese et al. | 99/275 |
| 6,010,033 | A | * | 1/2000 | Dean | 222/113 |
| 6,092,381 | A | | 7/2000 | Hsiao et al. | |

(Continued)

*Primary Examiner* — Kevin P Shaver
*Assistant Examiner* — Nicholas J Weiss

(57) ABSTRACT

A portable refrigeration system having a refrigerator unit with a door surface, aperture surface, dispenser surface, and inner cavity, a door pivotally attached to the door surface which can move between an open and closed position allowing and preventing access to the inner cavity, the unit further having standard refrigeration components for cooling the inner cavity, a base, the unit is mounted atop the base such that a gap exists between the dispenser surface and base, a first, second, third and fourth aperture are in the aperture surface, a lid removably attached to the aperture surface functioning to temporarily cover the apertures, which can move between an open and closed position allowing and preventing access to the aperture, a dispenser on the dispenser surface having a first dispenser for water or liquid and a second dispenser for ice, and a plurality of control buttons on the unit.

1 Claim, 4 Drawing Sheets

(56) References Cited

U.S. PATENT DOCUMENTS

| | | | | |
|---|---|---|---|---|
| 6,220,049 | B1 | 4/2001 | Lajeunesse | |
| D443,305 | S | 6/2001 | Stettes et al. | |
| 2006/0248914 | A1* | 11/2006 | Mullen | 62/390 |
| 2007/0138205 | A1* | 6/2007 | D'Aurizio | 222/146.6 |
| 2007/0215239 | A1* | 9/2007 | Dorney | 141/94 |
| 2012/0138635 | A1* | 6/2012 | Norris et al. | 222/131 |

* cited by examiner cross Sectional View as Seen From Front

PORTABLE REFRIGERATOR SYSTEM

FIELD OF THE INVENTION

The present invention is directed to a portable refrigerator and ice maker for operation inside a vehicle.

BACKGROUND OF THE INVENTION

Many individuals find themselves stopping at stores to get hot or cold drinks or ice, for example when traveling. The present invention features a portable refrigeration system. The system stores drinks and dispenses ice cubes. Hot or cold water can be dispensed. The system is not limited to use in vehicles; for example, in some embodiments, the system is used in boats and homes.

SUMMARY

The present invention features a portable refrigerator system. In some embodiments, the portable refrigerator system comprises a refrigerator unit having a door surface, an aperture surface, a dispenser surface, and an inner cavity, a door is pivotally attached to the door surface, the door can move between at least an open position and a closed position respectively allowing and preventing access to the inner cavity, the refrigerator unit further comprises standard refrigeration components for cooling the inner cavity; a base, the refrigerator unit is mounted atop the base such that a gap exists between the dispenser surface and the base; a first cavity, a second cavity, a third cavity, and a fourth cavity each disposed in the inner cavity of the refrigerator unit, the cavities are adapted to hold a liquid, the third cavity is adapted to optionally hold ice; a first aperture, a second aperture, a third aperture, and a fourth aperture each disposed in the aperture surface of the refrigerator unit, the first aperture provides access to the first cavity, the second aperture provides access to the second cavity, the third aperture provides access to the third cavity, and the fourth aperture provides access to the fourth cavity; a lid removably attached to the aperture surface, the lid functions to temporarily cover the apertures, the lid can move between at least an open position and a closed position respectively allowing and preventing access to the aperture; a dispenser disposed on the dispenser surface of the refrigerator unit, the dispenser comprises a first dispenser component and a second dispenser component, the first cavity, second cavity, and fourth cavity are each fluidly connected to the first dispenser component and the third cavity is fluidly connected to the second dispenser component; and a plurality of control buttons disposed on the refrigerator unit.

In some embodiments, the door is pivotally attached to the door surface via a hinge. In some embodiments, a handle is disposed on the door. In some embodiments, a light is disposed on the dispenser surface of the refrigerator unit.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
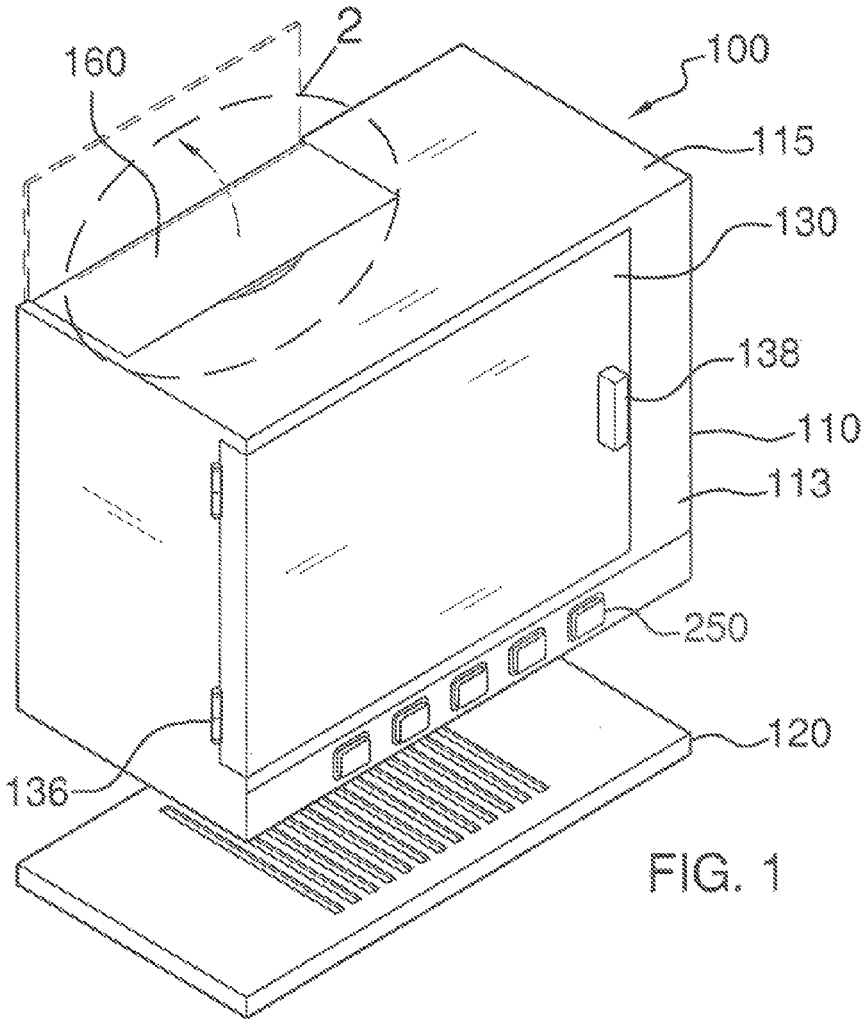
FIG. 1 is a perspective view of the portable refrigerator system of the present invention.
Figure 2:
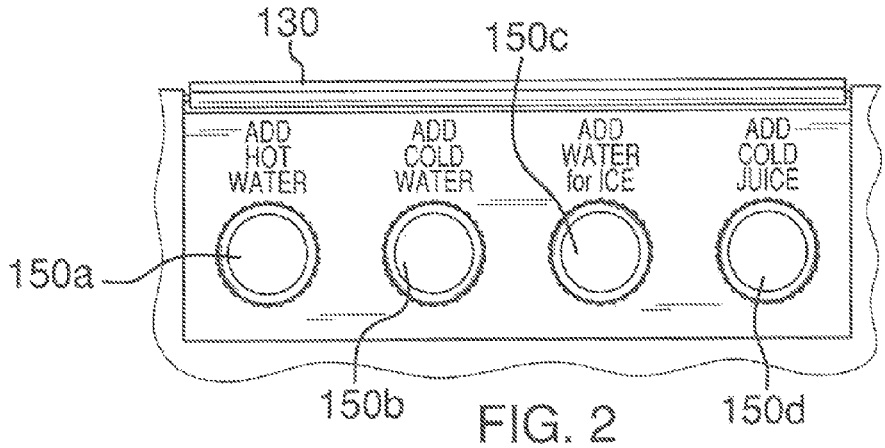
FIG. 2 is an exploded view of the top of the portable refrigerator system of the present invention.

Referring now to FIG. 1-6, the present invention features a portable refrigeration system 100. The system 100 comprises a refrigerator unit 110. The refrigerator unit 110 resembles standard refrigerators, which are well known to one of ordinary skill in the art. For example, the refrigerator unit has a door surface 113 (e.g., a front surface), an aperture surface 115 (e.g., a top surface), a dispenser surface 116 (e.g., a bottom surface) and an inner cavity 117 with a compartment 118 adapted to hold items (e.g., beverages, etc.). The refrigerator unit 110 comprises standard refrigeration components for cooling the inner cavity 117 (e.g., a compressor 107, a condenser 106, Freon, microprocessor for temperature control, etc.).

The refrigeration components are operatively connected to a power cord (e.g., a 110 volt power cord, a 12 volt power cord for connection to the battery of the vehicle). Power cords are well known to one of ordinary skill in the art.

In some embodiments, the refrigerator unit 110 is mounted atop a base 120. A gap 128 exists between the dispenser surface 116 and the base 120, providing room for a user to access the dispenser 210.

A door 130 is disposed on the door surface 113 of the refrigerator unit 110. The door 130 may be pivotally attached to the door surface 113 (e.g., via a hinge 136). The door 130 can move between at least an open position and a closed position respectively allowing and preventing access to the inner cavity of the refrigerator unit 110. In some embodiments, a handle 138 is disposed on the door 130.

A first aperture 150*a*, a second aperture 150*b*, a third aperture 150*c*, and a fourth aperture 150*d* are each disposed in the aperture surface 115 of the refrigerator unit 110. In some embodiments, the first aperture 150*a* is used for adding hot water. In some embodiments, the second aperture 150*b* is used for adding cold water. In some embodiments, the third aperture 150*c* is used for adding water for ice. In some embodiments, the fourth aperture is used for adding juice. A lid 160 is removably attached (e.g., pivotally attached) to the aperture surface 115. The lid 160 functions to temporarily cover the apertures 150. The lid 160 can move between at least an open position and a closed position respectively allowing and preventing access to the aperture 150.

Figure 6:
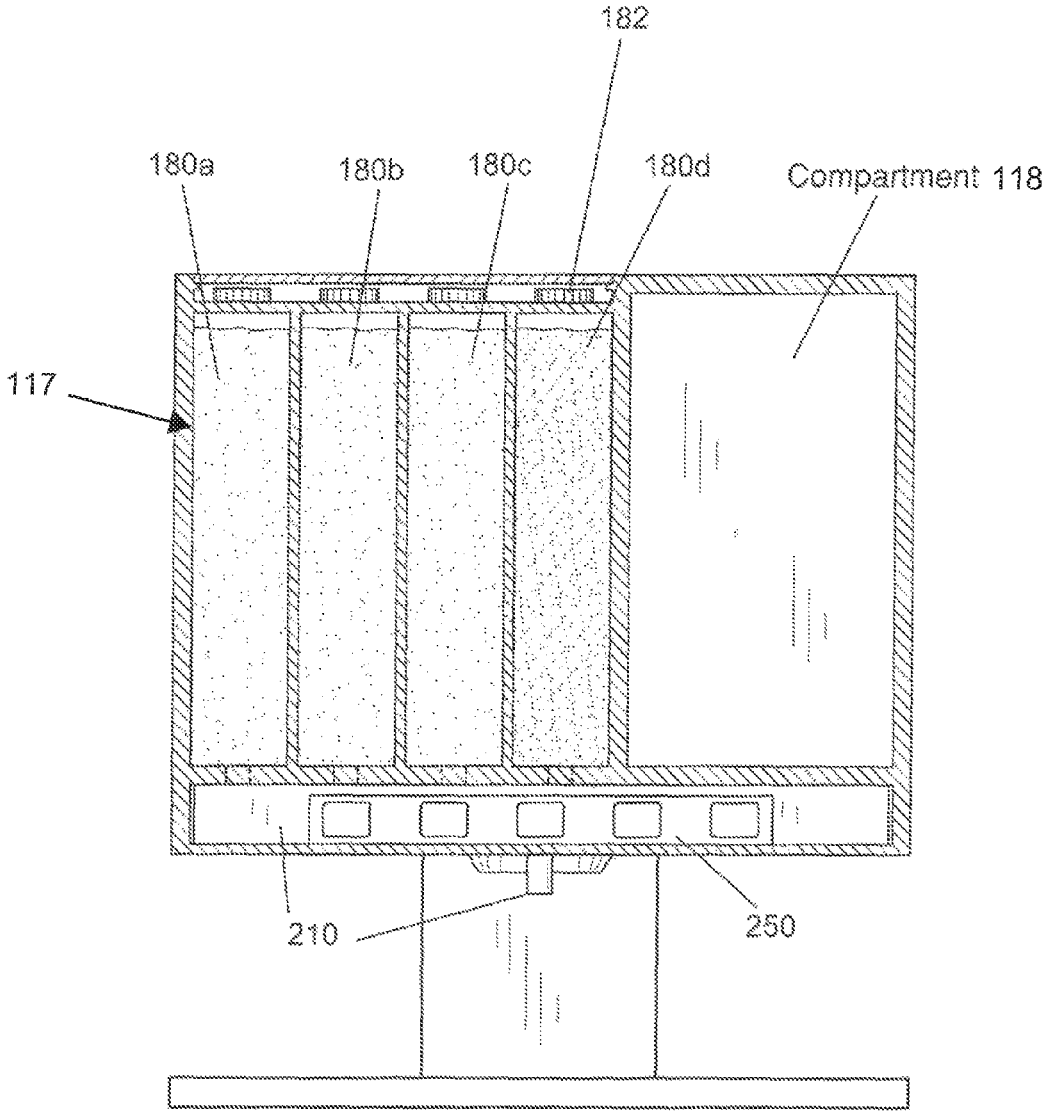
FIG. 6 is a front cross sectional view of the system of the present invention.

As shown in FIG. 6, the first aperture 150*a* provides access to a first cavity 180*a* disposed in the refrigerator unit 110. The second aperture 150*b* provides access to a second cavity 180*b* disposed in the refrigerator unit 110. The third aperture 150*c* provides access to a third cavity 180*c* disposed in the refrigerator unit 110. The fourth aperture 150*d* provides access to a fourth cavity 180*d* disposed in the refrigerator unit 110. In some embodiments, caps 182 are removably attached to one or more of the apertures 150. Each cavity can hold a liquid (e.g., hot water, cold water, juice, etc.). The liquids from the cavities 180 can be dispensed via the dispenser 210. For example, each cavity 180 is fluidly connected to the dispenser 210.

Figure 3:
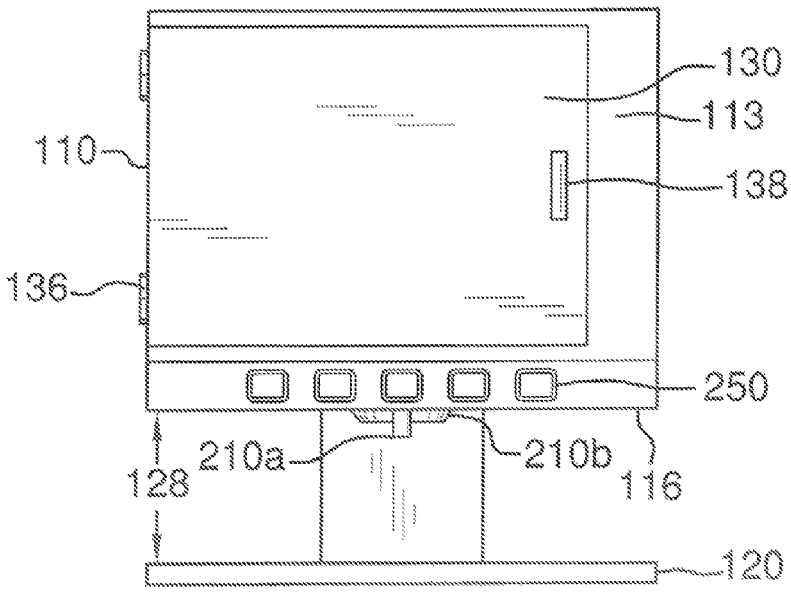
FIG. 3 is a front view of the portable refrigerator system of the present invention.
Figure 4:
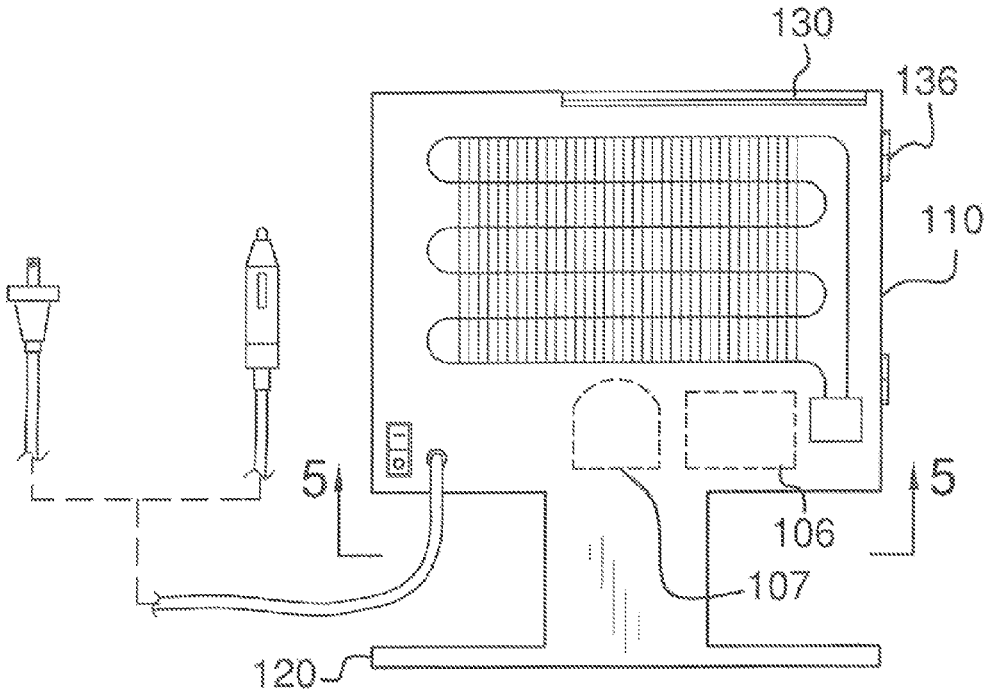
FIG. 4 is a back view of the portable refrigerator system of the present invention.
Figure 5:
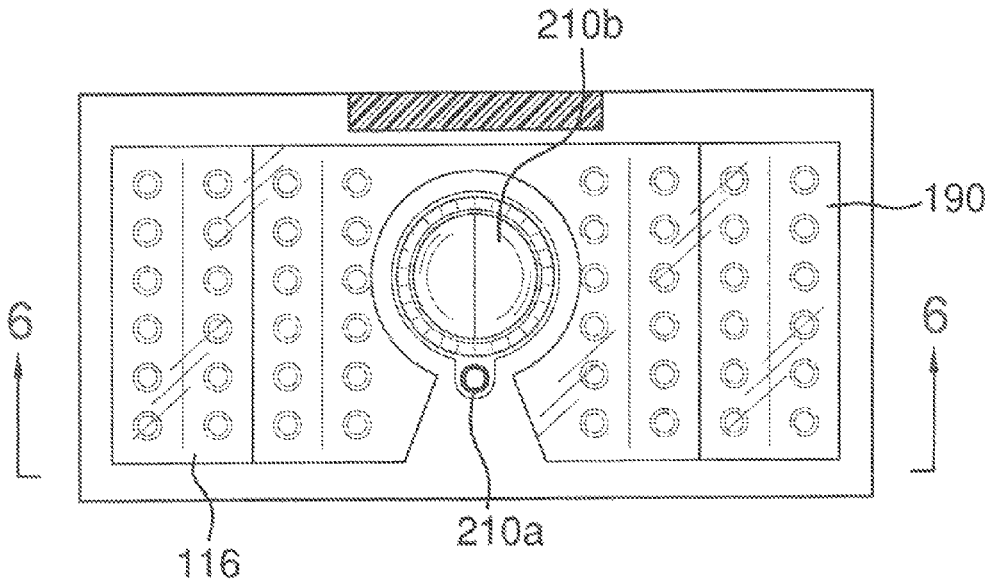
FIG. 5 is a bottom view of the portable refrigerator system of the present invention.

As shown in FIG. 3, a dispenser 210 is disposed on the dispenser surface 116 of the refrigerator unit 110. The dispenser 210 comprises a first dispenser component 210*a* (e.g., for water or liquid) and a second dispenser component 210*b* (e.g., for ice).

In some embodiments, one or more lights 190 (e.g., light emitting diodes) are disposed on the dispenser surface 116 of the refrigerator unit 110.

A plurality of control buttons 250 is disposed on the refrigerator unit 110, for example on the door surface 113. In some embodiments, a control button is adapted to control the lights 190. In some embodiments, a control button is adapted to turn the refrigerator unit 110 on and off. In some embodiments, a control button is adapted to cause ice to dispense from the second dispenser component 210*b*. In some embodiments, a control button is adapted to cause liquid or water to dispense from the first dispenser component 210*a*.

In some embodiments, the system 100 further comprises a cup holder. In some embodiments, the system 100 further comprises a soda can dispenser.

The system 100 may be constructed in a variety of shapes, sizes, colors, styles, and designs. For example, in some embodiments, the refrigerator unit 110 is between about 1 to 2 feet in height as measured form the aperture surface 115 to the dispenser surface 116. In some embodiments, the refrigerator unit 110 is between about 2 to 3 feet in height as measured form the aperture surface 115 to the dispenser surface 116. The present invention is not limited to the aforementioned dimensions.

As used herein, the term "about" refers, to plus or minus 10% of the referenced number. For example, an embodiment wherein the refrigerator unit 110 is about 1 foot in height includes a refrigerator unit 110 that is between 0.9 and 1.1 feet in height.

The disclosures of the following U.S. Patents are incorporated in their entirety by reference herein: U.S. Pat. No. 3,669,314; U.S. Pat. No. 4,342,202; U.S. Pat. No. 4,637,222; U.S. Pat. No. 4,913,318; U.S. Design Pat. No. D333070; U.S. Pat. No. 5,497,918; U.S. Pat. No. 5,701,754; U.S. Pat. No. 6,092,381; U.S. Design Pat. No. D443305; U.S. Pat. No. 6,220,049.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A portable refrigeration system (100) for providing beverages, said system (100) consisting of:

(a) a refrigerator unit (110) consisting of a door surface (113), a back surface, an aperture surface (115), a dispenser surface (116), a first side, a second side, and an inner cavity (117) with a fully isolated compartment (118) disposed adjacent to the second side, a door (130) is pivotally attached to the door surface (113), the door (130) can move between at least an open position and a closed position respectively allowing and preventing access to the inner cavity (117), the refrigerator unit (110) further consists of standard refrigeration components for cooling the inner cavity (117);

wherein the door (130) is pivotally attached to the door surface (113) via a hinge (136), wherein a handle (138) is disposed on the door (130);

wherein a light (190) is disposed on the dispenser surface (116) of the refrigerator unit (110);

(b) a planar base (120), the refrigerator unit (110) is mounted atop the base (120) such that a gap (128) exists between the dispenser surface (116) and the base (120);

wherein a base length is equal to a refrigerator unit length and a base width is equal to a refrigerator unit width;

(c) a first cavity (180*a*), a second cavity (180*b*), a third cavity (180*c*), and a fourth cavity (180*d*) each disposed in the inner cavity (117) of the refrigerator unit (110) adjacent to the first side and between the first side and the compartment (118), the cavities (180) are adapted to hold a liquid, the third cavity (180*c*) is adapted to optionally hold ice;

(d) a first aperture (150*a*), a second aperture (150*b*), a third aperture (150*c*), and a fourth aperture (150*d*) each disposed in the aperture surface (115) of the refrigerator unit (110) proximal to a back edge and a first side edge, the first aperture (150*a*) provides access to the first cavity (180*a*), the second aperture (150*b*) provides access to the second cavity (180*b*), the third aperture (150*c*) provides access to the third cavity (180*c*), and the fourth aperture (150*d*) provides access to the fourth cavity (180*d*), wherein each aperture consists of a removable cap (182) disposed thereon;

(e) a lid (160) removably attached to the aperture surface (115) adjacent to the first side edge and the back side edge, the lid (160) functions to temporarily cover the apertures (150), the lid (160) can move between at least an open position and a closed position respectively allowing and preventing access to the aperture (150);

(f) a dispenser (210) disposed on the dispenser surface (116) of the refrigerator unit (110), the dispenser (210) consists of a first dispenser component (210*a*) and a second dispenser component (210*b*), the first cavity (180*a*), second cavity (180*b*), and fourth cavity (180*d*) are each fluidly connected to the first dispenser component (210*a*) and the third cavity (180*c*) is fluidly connected to the second dispenser component (210*b*); and (g) a plurality of control buttons (250) disposed on the door surface (113) of the refrigerator unit (110).

* * * * *